US008430503B2

(12) United States Patent
Fukui

(10) Patent No.: US 8,430,503 B2
(45) Date of Patent: Apr. 30, 2013

(54) INKJET DYEING METHOD

(75) Inventor: Akira Fukui, Tokyo (JP)

(73) Assignee: Takata Corporation, Tokyo (JP)

( * ) Notice: Subject to any disclaimer, the term of this patent is extended or adjusted under 35 U.S.C. 154(b) by 0 days.

(21) Appl. No.: 13/304,068

(22) Filed: Nov. 23, 2011

(65) Prior Publication Data

US 2012/0066843 A1 Mar. 22, 2012

Related U.S. Application Data

(62) Division of application No. 12/461,594, filed on Aug. 18, 2009, now Pat. No. 8,220,921.

(30) Foreign Application Priority Data

Aug. 29, 2008 (JP) ..... 2008-222775

(51) Int. Cl.
*B41J 2/01* (2006.01)

(52) U.S. Cl.
USPC ..... 347/104; 347/100

(58) Field of Classification Search ..... 347/100, 347/104
See application file for complete search history.

(56) References Cited

U.S. PATENT DOCUMENTS

| | | | | |
|---|---|---|---|---|
| 4,211,094 | A | 7/1980 | Meisen | |
| 6,267,518 | B1 * | 7/2001 | Abe | 400/188 |
| 2003/0030686 | A1 * | 2/2003 | Abe et al. | 347/16 |
| 2003/0161673 | A1 * | 8/2003 | Speich | 400/615.2 |
| 2006/0125899 | A1 * | 6/2006 | Cornish et al. | 347/104 |

FOREIGN PATENT DOCUMENTS

| | | | |
|---|---|---|---|
| JP | H02-079358 | U | 6/1990 |
| JP | H03-045774 | A | 2/1991 |
| JP | H07-150481 | A | 6/1995 |
| JP | H09-217264 | A | 8/1997 |
| JP | H09-240068 | A | 9/1997 |
| JP | H11-081162 | A | 3/1999 |
| JP | H11-315484 | A | 11/1999 |
| JP | 2003-342882 | A | 12/2003 |
| JP | 2006-264813 | A | 10/2006 |
| JP | 2007-50955 | A | 3/2007 |

OTHER PUBLICATIONS

Japan Patent Office, "Office Action for JP 2008-222775", Feb. 20, 2013.

* cited by examiner

*Primary Examiner* — Laura Martin
(74) *Attorney, Agent, or Firm* — Manabu Kanesaka

(57) ABSTRACT

An inkjet dyeing method for dyeing a belt-shape textile by ejecting ink includes a feeding step of feeding the textile to an inkjet dyeing apparatus, a front surface printing step of dyeing the textile by ejecting the ink onto a front surface of the textile, a front surface drying step of drying the front surface of the textile, an inverting step of inverting the textile, a rear surface printing step of dyeing the textile by ejecting ink onto a rear surface of the textile, and a rear surface drying step of drying the rear surface of the textile.

6 Claims, 8 Drawing Sheets

INKJET DYEING METHOD

CROSS-REFERENCE TO RELATED APPLICATION

The present application is a divisional application of Ser. No. 12/461,594 filed on Aug. 18, 2009, which claims the priority of Japanese patent application No. 2008-222775 filed Aug. 29, 2008.

BACKGROUND OF THE INVENTION AND RELATED ART STATEMENT

The present invention relates to an inkjet dyeing method. More specifically, it relates to an inkjet dyeing method suitable for continuous printing on a belt-like textile such as a seat belt webbing.

As a dyeing method for seat belt webbing, a method disclosed in, for example, Japanese Patent No. 3240674: Patent Document 1 is known. According to the method disclosed in Patent Document 1, the seat belt webbing is subjected to a certain amount of tension with a first tensioner and a second tensioner while it is immersed in a dye solution in a dye padding process for a dye attachment and dried in a hot-air oven for dye developing and fixing.

Also, a method disclosed in, for example, Japanese Unexamined Patent Application Publication No. 5-318721: Patent Document 2 is known as a method for recording (printing) of a cloth or wallpaper. According to the method disclosed in Patent Document 2, a cloth is rewound from the dispenser roll of a cloth feeding section while it is fed to a printing section, provided with ink ejected from an ink jet recording section, dried in a drying section for ink developing and fixing, and rewound at a taking-up section.

The dyeing method disclosed in Patent Document 1, however, causes problems that only one-color dyeing with no patterns can be achieved since the webbing is immersed in the dye solution, that a large space is required for a water bath for a dye solution and a hot-water washing solution, and that it is necessary to treat a waste dyeing solution and to install a gas tank and a steam boiler and the like, thereby increasing a burden on the environment.

The recording method described in Patent Document 2 also has a disadvantage, and is mainly used in single-side printing since it is intended mainly for a cloth and textile used for clothing and wallpaper. Therefore, it does not mention its application to a two-side printing. Furthermore, the recording method described in Patent Document 2 is not suitable for a high-speed printing because an ink head is moving on a printed surface while ejecting an ink due to its extended range of printing.

Accordingly, the present invention has been made in light of the foregoing. An object of the present invention is to provide an inkjet dyeing method suitable for continuous printing for a belt-like textile such as a seat belt webbing, which allows various colors and patterns to be printed on both sides of the textile while reducing burdens on the environment.

Further objects and advantages of the invention will be apparent from the following description of the invention.

SUMMARY OF THE INVENTION

The present invention provides an inkjet dyeing method for dyeing a belt-like textile by ejecting ink, which includes a feeding step of feeding the textile to an inkjet dyeing apparatus, a front surface printing step of dyeing the textile by ejecting ink to the front surface of the textile, a front surface drying step of drying the front surface of the textile, an inverting step of inverting the textile, a rear surface printing step of dyeing the textile by ejecting ink to the rear surface of the textile, and a rear surface drying step of drying the rear surface of the textile. The textile may be conveyed in a loop so that the front surface printing step and the rear surface printing step can be simultaneously performed.

In the inverting step described above, textile inverting may be accomplished by turning the textile by approximately 90 degrees followed by further turning the textile by approximately 90 degrees. Also, in the inverting step, the textile may be inverted in such a manner that the pre-inverted textile and the post-inverted textile run in parallel.

In the front surface drying step and the rear surface drying step, the textile may be dried so that the ink does not migrate to a transporting roller. Also, a second drying step of drying both sides of the textile may be provided following the rear surface drying step.

Furthermore, the present invention provides an inkjet dyeing apparatus for dyeing a belt-like textile by ejecting ink. The inkjet dyeing apparatus includes a feeding section for feeding a textile to a front surface printing line, a front surface printing section disposed on the front surface printing line for dyeing the textile by ejecting ink to the front surface of the textile, a front surface drying section for drying the front surface of the textile, an inverting section for inverting and feeding the textile to the rear surface printing line, a rear surface printing section disposed on the rear surface printing line for dyeing the textile by ejecting ink to the rear surface of the textile, a rear surface drying section for drying the rear surface of the textile, a transporting section for transporting the textile to the next step, and a control unit for controlling the ejecting of the ink. A second drying section for drying both sides of the textile may be provided at a downstream of the transporting section.

Preferably, the front surface printing section and the rear surface printing section comprise inkjet heads secured to the front surface printing line and the rear surface printing line. The front surface printing line and the rear surface printing line are disposed in a loop shape so that they are in parallel to each other and are directed toward the same moving direction, while the front surface printing section and the rear surface printing section may comprise the same inkjet head. The front surface drying section, the inverting section, and the rear surface drying section may be disposed below the front surface printing line and the rear surface printing line.

The inverting section may comprise a first guide section for transporting the textile on the front surface printing line to an inverting line substantially perpendicular to the front surface printing line, a second guide section for transporting the textile to the rear surface printing line substantially perpendicular to the inverting line, and an intermediate guide line for allowing the textile on the inverting line to make a U-turn. The transporting distance between the first guide section and the intermediate guide section and the transporting distance between the intermediate guide section and the second guide section may be set to be different from each other.

It is preferable that the feeding section and the transporting section be structured so as to give the textile a certain amount of elongation. Also, the control unit may be structured so that ejecting timing of the ink is adjusted to suit the elongation of the textile on the front surface printing line and the rear surface printing line. The inkjet dyeing method and apparatus according to the present invention described above allow a textile with its front surface subjected to printing to be inverted so as to enable its rear surface to be ready for printing, thereby allowing both surfaces of the textile to be easily subjected to continuous printing. Use of inkjet systems as a method for dyeing a belt-like textile such as the seat belt webbing enables a textile to be dyed without using a dyeing solution that requires waste solution treatment processes, thereby reducing burdens on the environment. Also, it eliminates necessity for installations such as a gas tank or a steam boiler or the like, thereby downsizing equipments, and reducing cost and burdens on the environment. Furthermore, it enables dyeing without immersing the textile in the dye solution, thereby allowing various colors and patterns to be printed. Therefore, it gives an additional value of design to the seat belt webbing that would otherwise appear to be monotonous. In addition, product information contained in a tag, which conventionally has been attached to the seat belt webbing after the dyeing process, can be printed on the surface of the seat belt webbing, resulting in a reduction in manufacturing man-hours.

The textile is transported in such a manner that both-side printing can be provided simultaneously, thereby effectively reducing the size of the apparatus. Also, for textile inversion, the textile is smoothly inverted by inverting the textile by 90 degrees at a time, thereby preventing the front and rear surfaces of the textile from coming into contact with each other during the inversion which causes ink wear or color migration. Furthermore, the pre-inverted textile and the post-inverted textile run in parallel, thereby allowing the textile to be transported in such a manner that the front surface printing line and the rear surface printing line are in parallel with each other and are directed toward the same direction and also allowing both sides of the textile to be simultaneously printed at one path, resulting in improved printing efficiency.

Also, an appropriate drying step inserted after the front surface printing and rear surface printing allows excessive ink to be dried, thereby suppressing color migration to the transporting roller. Furthermore, the second drying step (second drying section) for securely drying both sides of the textile allows ink to produce color and also allows ink to be fixed to the textile.

Also, a certain amount of elongation provided to the textile allows printing accuracy to be improved, thereby creating beautiful patterns on the textile under normal conditions (service conditions). Furthermore, even if yellow, magenta, cyan, and black colors are over-painted, ink misalignment can be prevented, thereby allowing beautiful designs or patterns to be printed.

Also, disposing the drying section and the inverting section below the printing sections (front surface printing section and rear surface printing section) can reduce dead spaces inside the inkjet dyeing apparatus, thereby downsizing the apparatus.

BRIEF DESCRIPTION OF THE DRAWINGS

FIGS. 2(A), 2(B) are views as seen from line 2-2 of FIG. 1, wherein FIG. 2(A) shows the case where four textiles are subjected to printing, and FIG. 2(B) shows the case where two textiles are subjected to printing.

FIGS. 3(A), 3(B) are diagrams showing inverting sections, wherein FIG. 3(A) is an expanded view, and FIG. 3(B) is a view as seen from 3B of FIG. 3(A).

FIGS. 6(A), 6(B) are views as seen from line 6-6 of FIG. 5, wherein FIG. 6(A) shows the case where two textiles are subjected to printing, and FIG. 6(B) shows the case where one textile is subjected to printing.

FIGS. 7(A), 7(B) are diagrams showing inverting sections according to a third embodiment, wherein FIG. 7(A) is an expanded view, and FIG. 7(B) is a view as seen from 7B of FIG. 7(A).

DETAILED DESCRIPTION OF PREFERRED EMBODIMENTS

Figure 1:
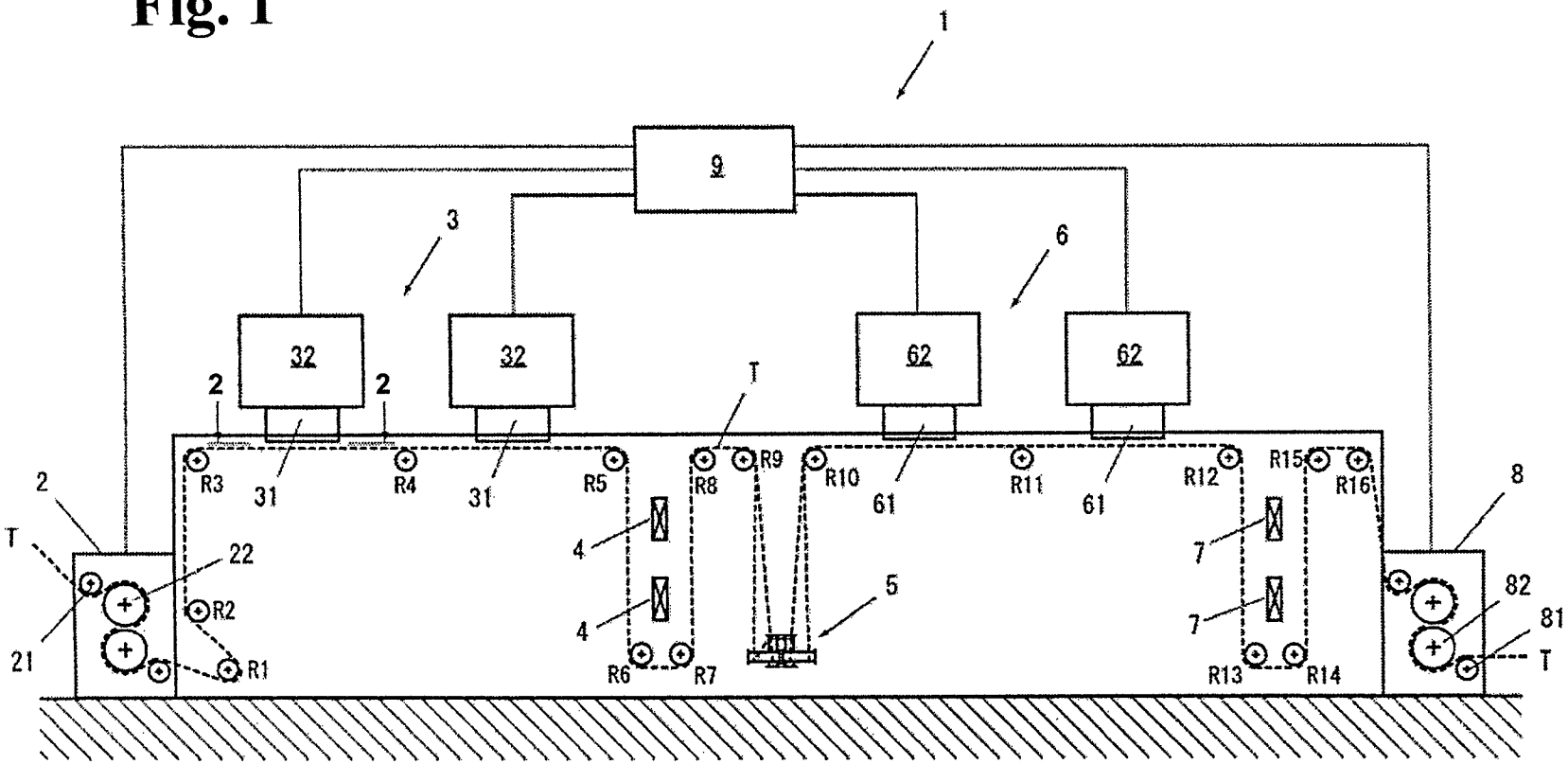
FIG. 1 is a configuration diagram showing an inkjet dyeing apparatus according to a first embodiment of the present invention.
Figure 2A:
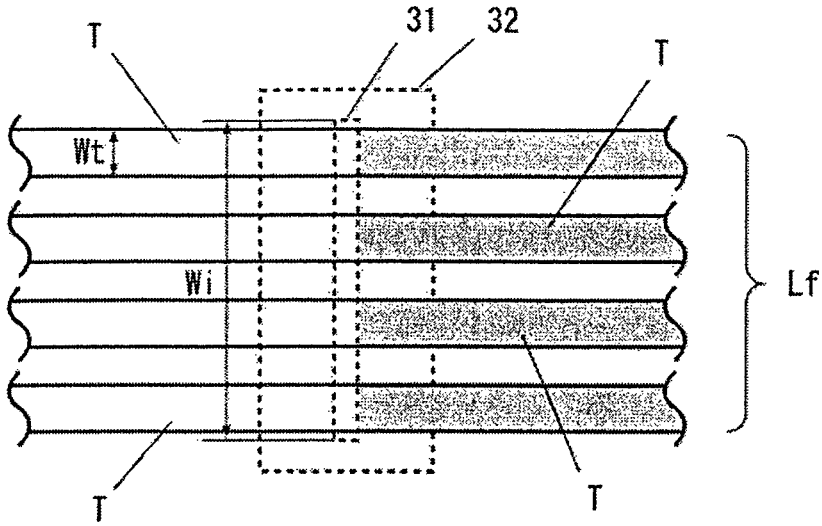
Figure 2B:
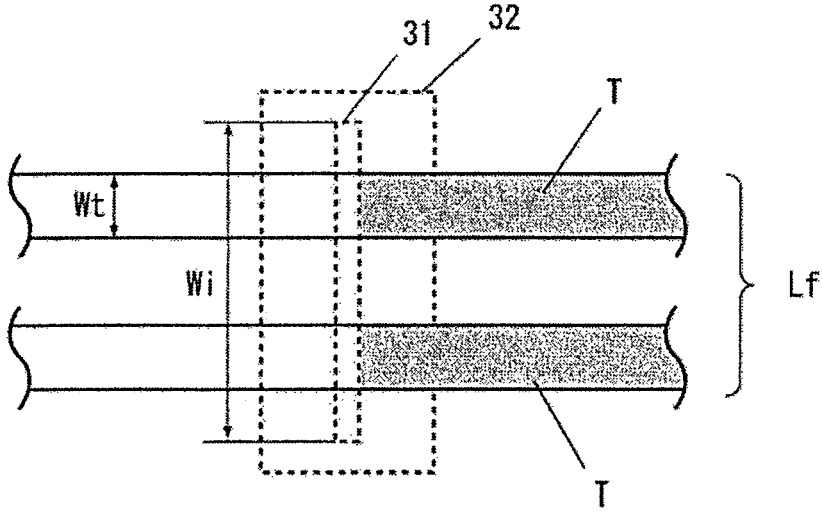

Embodiments of the present invention will be described below with reference to FIGS. 1 to 8. FIG. 1 is a configuration diagram showing an inkjet dyeing apparatus according to a first embodiment of the present invention. FIGS. 2(A), 2(B) are views taken along line 2-2 of FIG. 1, wherein FIG. 2(*a*) shows the case where four textiles are subjected to printing, while FIG. 2(B) shows the case where two textiles are subjected to printing. Shadow areas in FIGS. 2(A), 2(B) show the printed state of a textile.

An inkjet dyeing apparatus 1 as shown in FIG. 1 is an inkjet dyeing apparatus that dyes a belt-like textile T by ejecting ink, which includes a feeding section 2 for transporting the textile T to a front surface printing line Lf, a front surface printing section 3, disposed on the front surface printing line Lf, which dyes the front surface of the textile T by ejecting ink, a front surface drying section 4 for drying the front surface of the textile T, an inverting section 5 that inverts the textile T and carries the textile T to the rear surface printing line Lr, a rear surface printing section 6, disposed on the rear surface printing line Lr, which dyes the rear surface of the textile T by ejecting ink, a rear surface drying section 7 for drying the rear surface of the textile T, a transporting section 8 for transporting the textile T to the next step, and a control unit 9 for controlling the ejecting of the ink.

The textile T is a belt-like textile such as a seat belt webbing or the like. The textile T is supported by a plurality of transporting rollers R1 to R16 while being transported in the inkjet dyeing apparatus 1. Some of the transporting rollers R1 to R16 comprise transporting rollers each of which is rotated around its axis by an electric motor, and may be structured so as to exert transporting force to the textile T. The arrangement of the transporting rollers R1 to R16 shown in FIG. 1 is shown as an example and is not limited to this.

The feeding section 2 and the transporting section 8 comprise, for example, dancer rolls 21, 81 and tension rolls 22, 82 and are structured so as to enable the elongation of the textile T to be freely adjusted between the feeding section 2 and the transporting section 8. The elongation provided to the textile T by the feeding section 2 and the transporting section 8 is appropriately determined according to conditions such as the material, thickness and width of the textile T, the type of ink and the like. For adjustment of elongation provided to the textile T, the feeding section 2 and the transporting section 8 may be individually adjusted on an automatic basis in such a manner that each of them can give a certain amount of elongation to the textile T. Alternatively, the elongation may be adjusted on an automatic basis by measuring each tension and performing feeding back of the tension through the control unit 9. Also, a tension measuring instrument may be provided on any of the transporting rollers R3 to R5, R10 to R12 disposed in the vicinity of the front surface printing section 3 and the rear surface printing section 6, thereby monitoring the textile T for elongation at printing sections 3, 6 in order to allow the feeding section 2 and the transporting section 8 to adjust the elongation provided to the textile T.

The front surface printing section 3 and the rear surface printing section 6 have inkjet heads 31, 61 and ink tanks 32, 62. As shown in FIGS. 2(A), 2(B), the inkjet head 31 has a width Wi larger than the width Wt of the textile T and is secured onto the front surface printing line Lf. Use of the inkjet head 31 having a width Wi larger than the width Wt of the textile T allows ink to be ejected to the textile T without moving the inkjet head 31 in a horizontal plane, allows a plurality of textiles T to be simultaneously printed, and also allows ink to be easily sprayed to the sides of the textile T.

A small head capable of high-speed driving, for example, complying with thin-film piezo inkjet head specifications is used as the inkjet head 31. The number of textiles T that can be printed simultaneously is determined by the relationship between the width Wt of the textile T and the width Wi of the inkjet head 31. Four front surface printing lines Lf can be disposed as shown in FIG. 2(A), or two front surface printing lines Lf can be disposed as shown in FIG. 2(B).

For example, in the case where the inkjet head has a width Wi of 230 mm and the textile T has a width Wt of 50 mm (equivalent to the width of ordinary webbing), four front surface printing lines Lf can be disposed as shown in FIG. 2(A). Also, in the case where the inkjet head has a width Wi of 230 mm and the textile T has a width Wt of 80 mm (equivalent to the width of race car webbing or air belts), two front surface printing lines Lf can be disposed as shown in FIG. 2(B). Even in the case where a plurality of textiles T can be printed simultaneously, one front surface printing line Lf may be used to print the textile T.

Also, as shown in FIG. 1, each of the front surface printing section 3 and the rear surface printing section 6 is divided into two, in which the upstream printing sections 3, 6 jet, for example, yellow and magenta inks, while the downstream printing sections 3 jet, for example, cyan and black inks. In other words, the upstream ink tanks 32, 62 of the printing sections 3, 6 are charged with yellow and magenta inks, respectively, while the downstream ink tanks 32, 62 are charged with cyan and black inks, respectively. Needless to say, each of the printing sections 3, 6 may comprise one inkjet head 31, 61 and ink tank 32, 62 so as to be able to simultaneously jet yellow, magenta, cyan, and black inks. Alternatively, each of the printing sections 3, 6 may comprise four inkjet heads 31, 61 and ink tanks 32, 62 so as to be able to jet yellow, magenta, cyan, and black inks individually. The ink may be either dye-based or pigmented. The front surface printing section 3 and the rear surface printing section 6 are similar to other ordinary inkjet printing mechanisms except that fixed inkjet heads 31, 61 are used, and detailed descriptions thereof are omitted.

The front surface drying section 4 and the rear surface drying section 7 comprise, for example, an electric heater. In these sections, an amount of heat is sufficient such that the textile T is dried so that the ink does not migrate to the transporting rollers R6 to R16. As shown in FIG. 1, the textile T is transported in the shape of a U through the transporting rollers R5, R12 to R8, R15, and the front surface drying section 4 and the rear surface drying section 7 are disposed in recesses created below the transporting path of the textile T. In other words, the textile T is transported in such a manner that its surface immediately after being subjected to inkjet printing faces each of the drying sections 4, 7. The distance between the textile T and each of the drying sections 4, 7 is determined by the amount of heat generated by the electric heater or the type and the amount of ink ejected to the textile T. The transporting rollers R6, R7, R13, R14 may be omitted so that the textile T is transported straight, and the front surface drying section 4 and the rear surface drying section 7 may be disposed between the transporting rollers R5, R12 and the transporting rollers R8, R15, respectively.

The inverting section 5 is a section that inverts the textile T whose front surface has been printed so as to allow its rear surface to be printed. To invert the textile T, the textile T needs to be turned by 180 degrees. However, turning the textile T by 180 degrees at a time causes the front and rear surfaces to come into contact with each other, which results in ink wear or ink migration. To solve the problem, according to the present invention textile inversion is accomplished by turning the textile by approximately 90 degrees followed by further turning the textile by approximately 90 degrees, namely, turning in two steps, 90 degrees at a time. As shown in FIG. 2(A), in the case where up to four textiles T can be printed at a time, four inverting sections 5 may be provided in the transporting path so that they can invert the textiles T, respectively. Alternatively, one inverting section 5 may be adapted to invert four textiles T all together.

Figure 3A:
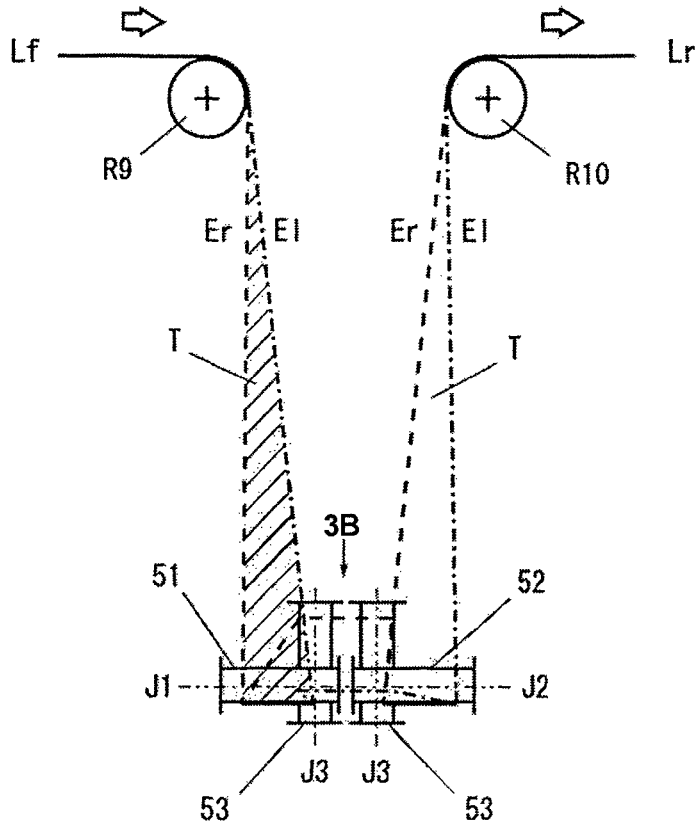
Figure 3B:
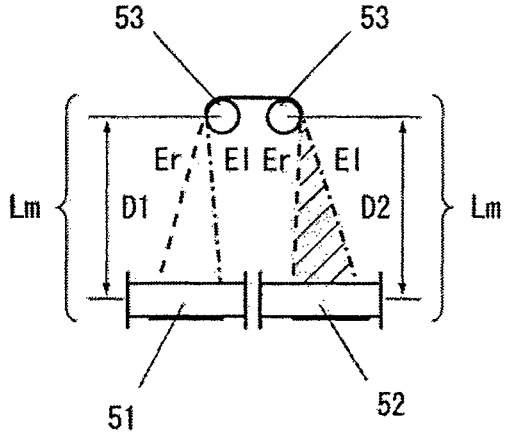

FIGS. 3(A) and 3(B) are diagrams showing an inverting section. FIG. 3(A) is an expanded view, and FIG. 3(B) is a view as seen from arrow 3B of FIG. 3(A). In these figures, shadow areas of the textile T represent printed surfaces (front surface). As shown in FIGS. 3(A) and 3(B), the inverting section 5 includes a first guide section 51 that carries the textile T on the front surface printing line Lf to an inverting line Lm substantially perpendicular to the front surface printing line Lf, a second guide section 52 that carries the textile to the rear surface printing line Lr substantially perpendicular to the inverting line Lm, and an intermediate guide line 53 that causes the textile T on the inverting line Lm to make a U-turn. The first guide section 51, the second guide section 52, and the intermediate guide section 53 may comprise a cylindrical guide bar slidable with the textile T or a transporting roller. Illustrations of the supporting members that support the first guide section 51, the second guide section 52, and the intermediate guide section 53 are omitted.

As shown in FIGS. 3(A) and 3(B), the shaft center J1 of the first guide section 51 is disposed at approximately 90 degrees relative to the shaft center (perpendicular to the top face of page) of the last transporting roller R9 on the front surface printing line Lf, transporting the textile T to the inverting line Lm substantially perpendicular to the front surface printing line Lf. The intermediate guide section 53 is disposed on the inverting line Lm to cause the textile T to make a U-turn. The intermediate guide section 53 is disposed in such a manner that its shaft center J3 is set at approximately 90 degrees relative to the shaft centers J1, J2 of the first guide section 51 and the second guide section 52. The intermediate guide section 53 may comprise one guide bar although it comprises two guide bars in this embodiment. The second guide section 52 is disposed in such a manner that it has the shaft center J2 coaxial with the shaft center J1 of the first guide section 51. In other words, as shown in FIG. 3(B), the transporting distance D1 between the first guide section 51 and the intermediate guide section 53 is set to be equal to the transporting distance D2 between the intermediate guide section 53 and the second guide section 52. The shaft center J2 of the second guide section 52 is disposed at approximately 90 degrees relative to the shaft center J10 of the first transporting roller R10 on the rear surface printing line Lr, transporting the textile T to the rear surface printing line Lr substantially perpendicular to the inverting line Lm.

The side edges Er, El of the textile T are indicated by dashed lines and dashed-dotted lines, respectively, in FIGS. 3(A) and 3(B), and routing of the textile T in the inverting section 5 is described below. In these figures, the edge Er on the right-hand side in the direction of movement of the textile T in the transporting roller R9 is indicated by dashed lines, while the edge El on the left-hand side in the direction of movement of the textile T is indicated by dashed-dotted lines. A determination as to whether Er or El is on the right-hand side or on the left-hand side is made by viewing from overhead the textile T passing through the transporting roller R9. The textile T passing through the transporting roller 9 while keeping the relationship of (right side, left side)=(edge Er, edge El) is transported to the first guide section 51 while keeping such a relationship. In other words, the textile T is transported through the first guide section 51 in such a manner that the surface (front surface) to be subjected to printing is disposed at the side (outer side) which does not come into contact with the first guide section 51. In addition, the textile T passing through the first guide section 51 while keeping the relationship of (right side, left side)=(edge Er, edge El) is transported to the intermediate guide section 53 while keeping such a relationship. Accordingly, as shown in FIG. 3(A), the edge Er (dashed lines) runs around the upper side of the intermediate guide section 53, while the edge El (dashed-dotted lines) runs around the lower side of the intermediate guide section 53. The textile T passing through the intermediate guide section 53 while keeping the relationship of (right side, left side)=(edge Er, edge El) is inverted at the second guide section 52 so as to give the relationship of (right side, left side)=(edge El, edge Er). In other words, the textile T is routed in such a manner that the edge Er (dashed lines) running around the upper side of the intermediate guide section 53 is disposed on the left side of the second guide section 52, while the edge El (dashed-dotted lines) running around the lower side of the intermediate guide section 53 is disposed on the right side of the second guide section 52. Accordingly, as shown in FIG. 3(B), the textile T is transported through the second guide section 52 in such a manner that the surface (front surface) to be subjected to printing is disposed at the side (inner side) which comes into contact with the second guide section 52. The textile T passing through the second guide section 52 while keeping the relationship of (right side, left side)=(edge El, edge Er) is transported to the transporting roller R10 while keeping such relationship. Routing the textile T in the inverting section 5 as described above allows the textile T to be smoothly inverted.

The control unit 9 is a section that mainly controls the amount of ink to be ejected and ink ejecting timing for the front surface printing section 3 and the rear surface printing section 6. The control unit 9 stores or has data for colors and patterns to be printed on the textile T transmitted thereto, and, on the basis of such data, jets yellow, magenta, cyan, and black inks to the textile T. The control unit 9 may be either a dedicated controller provided in the inkjet dyeing apparatus 1 or a computer connected online or via a network to the inkjet dyeing apparatus 1. Also, the control unit 9 may be adapted to monitor the elongation of the textile T while it controls ink ejecting timing as well as the elongation of the textile T of the feeding section 2 and the transporting section 8. As just described above, the control unit 9 adjusts ejecting timing to meet the elongation of the textile running on the front surface printing line Lf and the rear surface printing line Lr, thereby preventing ink misalignment to print aesthetically beautiful designs and patterns even when yellow, magenta, cyan, and black inks, for example, are superposed.

According to the inkjet dyeing apparatus 1 as described above, the textile T can be transported to the inkjet dyeing apparatus 1 from the feeding section 2, transported to the front surface printing section 3 through the transporting rollers R1 to R4, transported to the front surface drying section 4 through the transporting rollers R5 to R8, inverted by the inverting section 5 between the transporting rollers R9 and R10, transported to the rear surface printing section 6 through the transporting roller R10 and R11, transported to the rear surface drying section 7 through the transporting rollers R12 to R15, transported out to the transporting section 8 through the transporting roller R16, and the textile T subjected to printing on both surfaces thereof can be transported to the next step. Consequently, the inkjet dyeing apparatus 1 according to the present invention can implement the inkjet dyeing method which includes the feeding step of feeding the textile T to the inkjet dyeing apparatus 1, the front surface printing step of dyeing by ejecting ink onto the front surface of the textile T, the front surface drying step of drying the front surface of the textile T, the inverting step of inverting the textile T, the rear surface printing step of dyeing by ejecting ink onto the rear surface of the textile T, and the rear surface drying step of drying the rear surface of the textile T.

Figure 4:
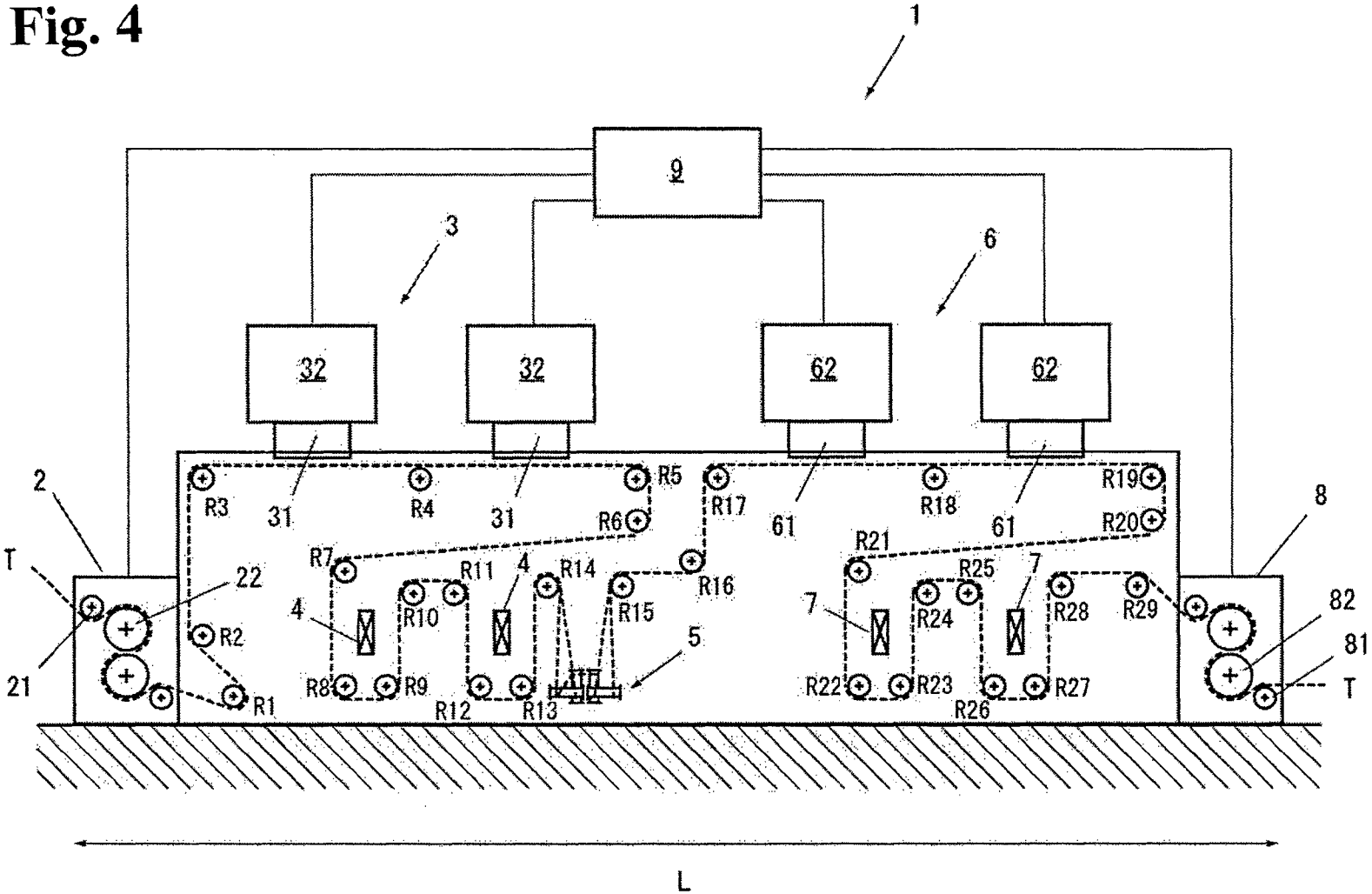
FIG. 4 is a configuration diagram showing an inkjet dyeing apparatus according to a second embodiment of the present invention.
Figure 5:
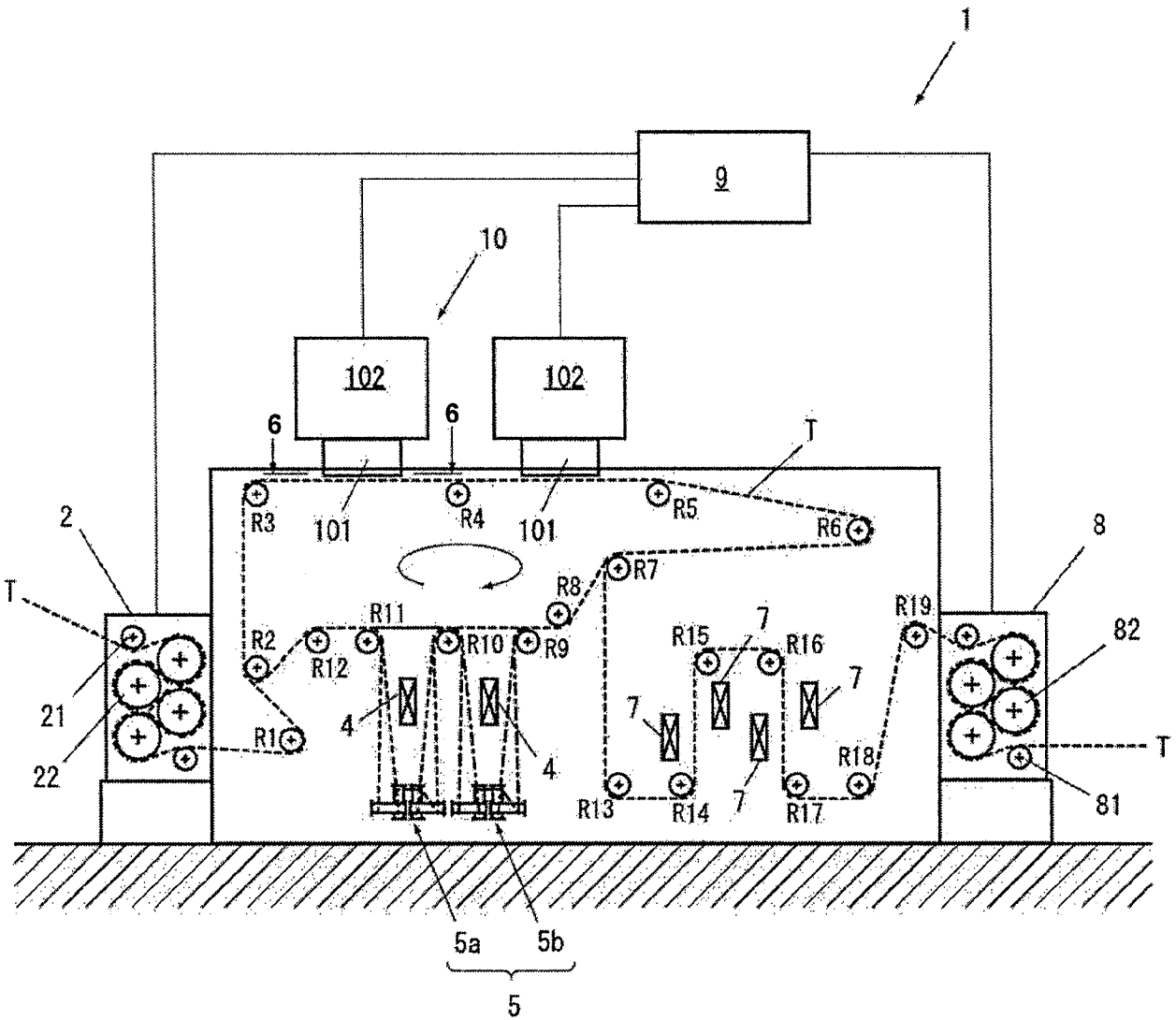
FIG. 5 is a configuration diagram showing an inkjet dyeing apparatus according to a third embodiment of the present invention.

Another embodiment of an inkjet dyeing apparatus according to the present invention is described below. FIG. 4 is a configuration diagram showing an inkjet dyeing apparatus according to a second embodiment of the present invention. FIG. 5 is a configuration diagram showing an inkjet dyeing apparatus according to a third embodiment of the present invention. The reference numerals and symbols in these figures refer to the same components as those with the same reference numerals and symbols in FIG. 1 showing an inkjet dyeing apparatus according to a second embodiment, and repeated descriptions of the same components are omitted.

Like the first embodiment as shown in FIG. 1, the inkjet dyeing apparatus 1 according to a second embodiment, as shown in FIG. 4, includes a feeding section 2 for feeding a textile T to a front surface printing line Lf, a front surface printing section 3, disposed on the front surface printing line Lf, which dyes the textile by ejecting ink onto the front surface of the textile T, a front surface drying section 4 for drying the front surface of the textile T, an inverting section 5 that inverts and feeds the textile T to the rear surface printing line Lr, a rear surface printing section 6, disposed on the rear surface printing line Lr, which dyes the textile by ejecting ink onto the rear surface of the textile T, a rear surface drying section 7 for drying the rear surface of the textile T, a transporting section 8 for transporting out the textile T to the next step, and a control unit 9 for controlling the ejecting of the ink. The textile T is transported through a plurality of transporting rollers R1 to R29 in the inkjet dyeing apparatus 1.

The inkjet dyeing apparatus 1 according to the second embodiment has the front surface drying section 4 and the inverting section 5 disposed below the front surface printing section 3 and has the rear surface drying section 7 disposed below the rear surface printing section 6. As just described, disposing the drying sections 4, 7 and the inverting section 5 below the printing sections 3, 6 can reduce dead spaces inside the inkjet dyeing apparatus, thereby allowing downsizing of the apparatus. In particular, the overall length L of the inkjet dyeing apparatus 1 can be reduced.

According to the inkjet dyeing apparatus 1 as described above, the textile T can be transported to the inkjet dyeing apparatus 1 from the feeding section 2, transported to the front surface printing section 3 through the transporting rollers R1 to R4, transported back to below the upstream front surface printing section 3 through transporting rollers R5 to R7, transported to the front surface drying section 4 through the transporting rollers R8 to R13, inverted by the inverting section 5 between the transporting rollers R14 and R15, transported to the rear surface printing section 6 through the transporting roller R16 and R18, transported back to below the upstream rear surface printing section 6 through the transporting rollers R19 to R21, transported to the rear surface drying section 7 through the transporting rollers R22 to R28, transported to the transporting section 8 through the transporting roller R29, and the textile T subjected to printing on both surfaces thereof can be transported to the next step.

The inkjet dyeing apparatus 1 according to a third embodiment, as shown in FIG. 5, includes a feeding section 2 for feeding a textile T to a front surface printing line Lf, a printing section 10, disposed on the front surface printing line Lf, which dyes the textile by ejecting onto the front surface of the textile T, a front surface drying section 4 for drying the front surface of the textile T, an inverting section 5 that inverts and feeds the textile T to the rear surface printing line Lr, a printing section 10, disposed on the rear surface printing line Lr, which dyes the textile by ejecting ink onto the rear surface of the textile T, a rear surface drying section 7 for drying the rear surface of the textile T, a transporting section 8 for transporting out the textile T to the next step, and a control unit 9 for controlling the ejecting of the ink. The printing section 10 has a structure similar to that of the front surface printing section 3 or the rear surface printing section 6, including an inkjet head 101 and a ink tank 102. The textile T is transported through a plurality of transporting rollers R1 to R19 in the inkjet dyeing apparatus 1.

In the inkjet dyeing apparatus 1 according to the third embodiment, the front surface printing line Lf and the rear surface printing line Lr are disposed in the form of a loop in such a manner that they are in parallel to each other and are directed toward the same direction of movement, while the front surface printing section and the rear surface printing section comprise the same printing section 10 (inkjet head 101). According to the inkjet dyeing apparatus 1 as described above, the textile T can be fed into the inkjet dyeing apparatus 1 from the feeding section 2, transported to the printing section 10 through the transporting rollers R1 to R4 to cause the front surface of the textile T to be printed, transported back to below the upstream printing section 10 through the transporting rollers R5 to R12, inverted by the inverting section 5 between the transporting rollers R9 and R10 or between the transporting rollers R10 and R11, dried by the front surface drying section 4 disposed between the inverting section 5 and the transporting rollers R9, R10 or the transporting rollers R10, R11, again transported to the printing section 10 through the transporting rollers R2 to 4 to cause the rear surface of the textile T to be printed, transported back to below the upstream printing section 10 through the transporting rollers R5 to R7, transported to the rear surface drying section 7 through the transporting rollers R13 to R18, transported to the transporting section 8 through the transporting roller R19, and the textile T subjected to both-surface printing can be transported to the next step. Accordingly, the textile T is transported in the form of a loop so as to allow the front surface printing step and the rear surface printing step to be simultaneously performed. As just described above, transporting the textile T to the printing section 10 in the form of a loop in the apparatus allows the printing section 10 to print both surfaces of the textile T, thereby downsizing the apparatus.

Figure 6A:
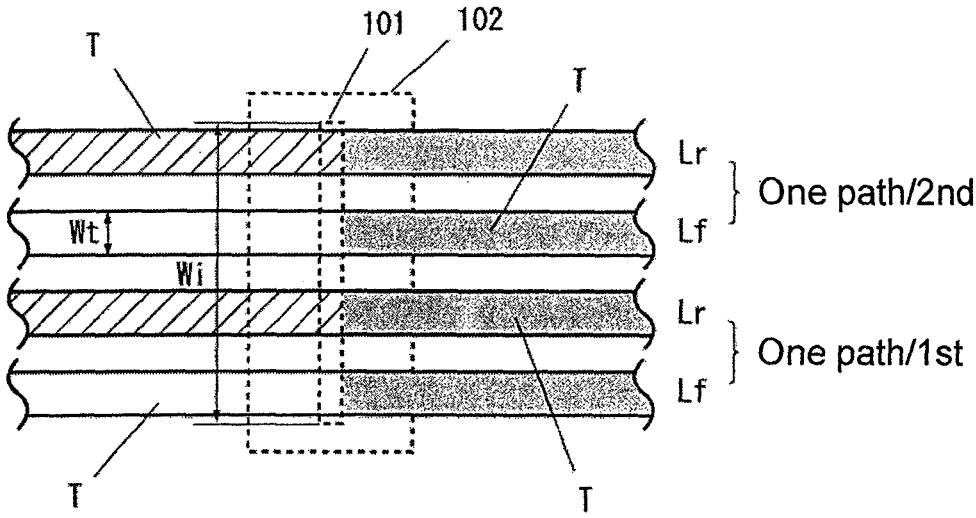
Figure 6B:
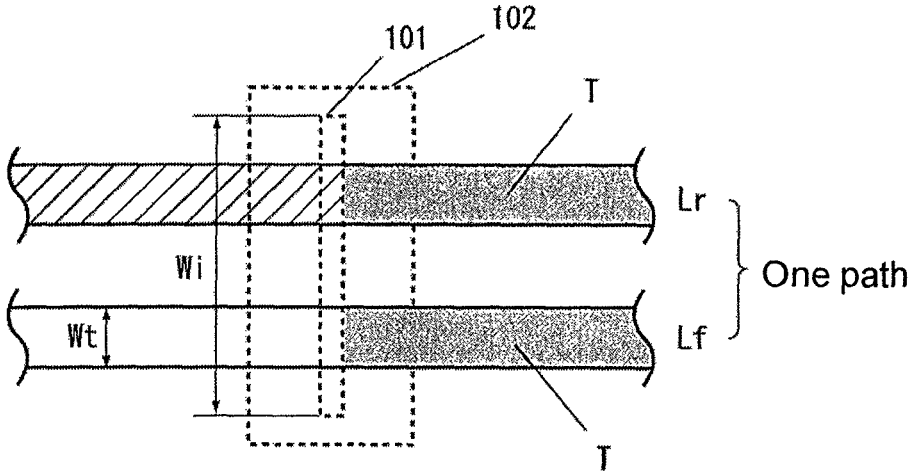

FIGS. 6(A), 6(B) are views as seen from line 6-6 of FIG. 5. FIG. 6(A) shows the case where two textiles are subjected to printing, and FIG. 6(B) shows the case where one textile is subjected to printing. Shadow areas in each figure show the printed state of a textile, while shaded areas show the state where a printed surface is disposed at the rear side. As shown in FIG. 2(A), the inkjet dyeing apparatus 1 according to a first embodiment can print four textiles T simultaneously since it has the front surface printing section 3 and the rear surface printing section 6 separately provided. On the other hand, the inkjet dyeing apparatus 1 according to a third embodiment has the printing section 10 provided for the purpose of both front surface and rear surface printing, which uses two lines for the front surface printing line Lf and the rear surface printing line Lr of the first textile T, and other two lines for the front surface printing line Lf and the rear surface printing line Lr of the first textile T, as shown in FIG. 6(A). In other words, the front surface printing line Lf and the rear surface printing line Lr of the first and second textiles T are disposed in the printing section 10 in such a manner that they are in parallel to each other and are directed toward the same direction of movement. This is because, as shown in FIG. 5, transporting the textile T in the form of a loop through the transporting rollers R2 to R12 allows the front surface printing line Lf and the rear surface printing line Lr to be disposed in the printing section 10 through one path.

Accordingly, in the case where the inkjet head 101 has a width Wi of, for example, 230 mm and the textile T has a width Wt of 50 mm (equivalent to the width of an ordinary webbing), two sets of the front surface printing line Lf and the rear surface printing line Lr comprising one path can be disposed, as shown in FIG. 6(A). Also, in the case where the inkjet head 101 has a width Wi of 230 mm and the textile T has a width Wt of 80 mm (equivalent to the width of race car webbing or air belts), one set of the front surface printing line Lf and the rear surface printing line Lr comprising one path can be disposed, as shown in FIG. 6(B). Even in the case where a plurality of textiles T can be printed simultaneously as shown in FIG. 6(A), one set of the front surface printing line Lf and the rear surface printing line Lr may be used to print the textile T.

Figure 7A:
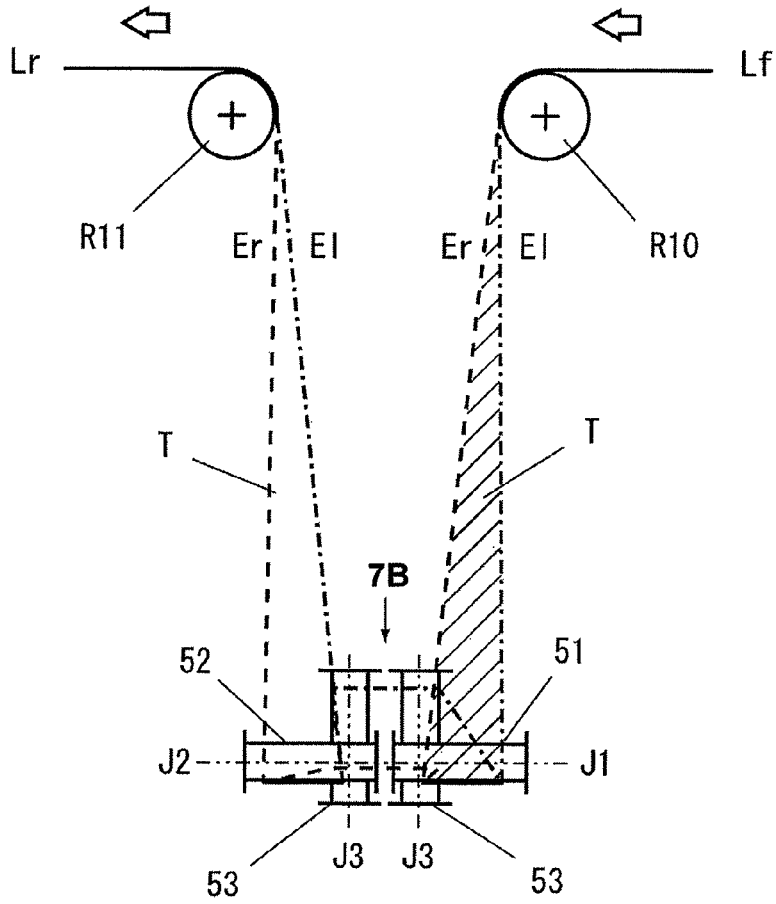
Figure 7B:
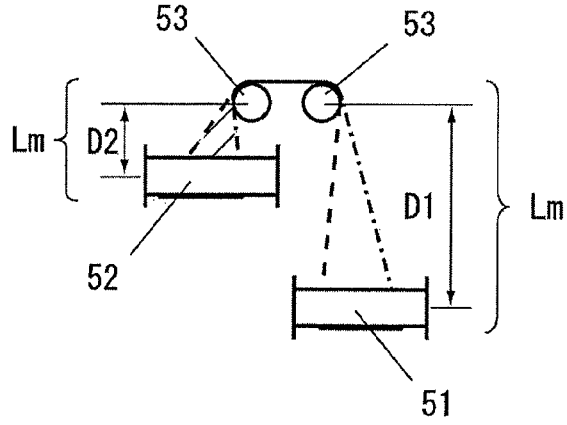

FIGS. 7(A) and 7(B) are diagrams showing an inverting section according to a third embodiment, wherein FIG. 7(A) is an expanded view, and FIG. 7(B) is a view as seen from 7B of FIG. 7(A). In these figures, shadow areas of the textile T represent printed surfaces (front surface). As shown in FIGS. 7(A) and 7(B), like the inverting section 5 according to a first embodiment, the inverting section 5 may comprise a first guide section 51 that carries the textile T on the front surface printing line Lf to an inverting line Lm substantially perpendicular to the front surface printing line Lf, a second guide section 52 that carries the textile to the rear surface printing line Lr substantially perpendicular to the inverting line Lm, and an intermediate guide line 53 that allows the textile T on the inverting line Lm to make a U-turn. FIG. 5 depicts two inverting sections 5*a*, 5*b*, which represent the structure where an inverting section 5*a* for the first textile T and an inverting section 5*b* for the second textile T are separately provided.

The inverting and routing methods, as shown in FIGS. 7(A) and 7(B), for the textile T in the inverting section 5 according to the third embodiment are the same as those for the inverting section 5 according to the first embodiment. In the inverting section 5 according to the third embodiment as shown in FIGS. 7(A) and 7(B), however, the transporting distance D1 between the first guide section 51 and the intermediate guide section 53 and the transporting distance D2 between the intermediate guide section 53 and the second guide section 52 are set to be different from each other. Different transporting distances D1, D2 as just described allow the transporting lines for the pre-inverted and post-inverted textiles T to be shifted from each other, thereby enabling the textile T to be inverted in such a manner that the pre-inverted and post-inverted textiles T run in parallel to each other and thereby enabling the front surface printing line Lf and the rear surface printing line Lr to be disposed in such a manner that they are in parallel to each other and directed toward the same direction of movement.

Figure 8:
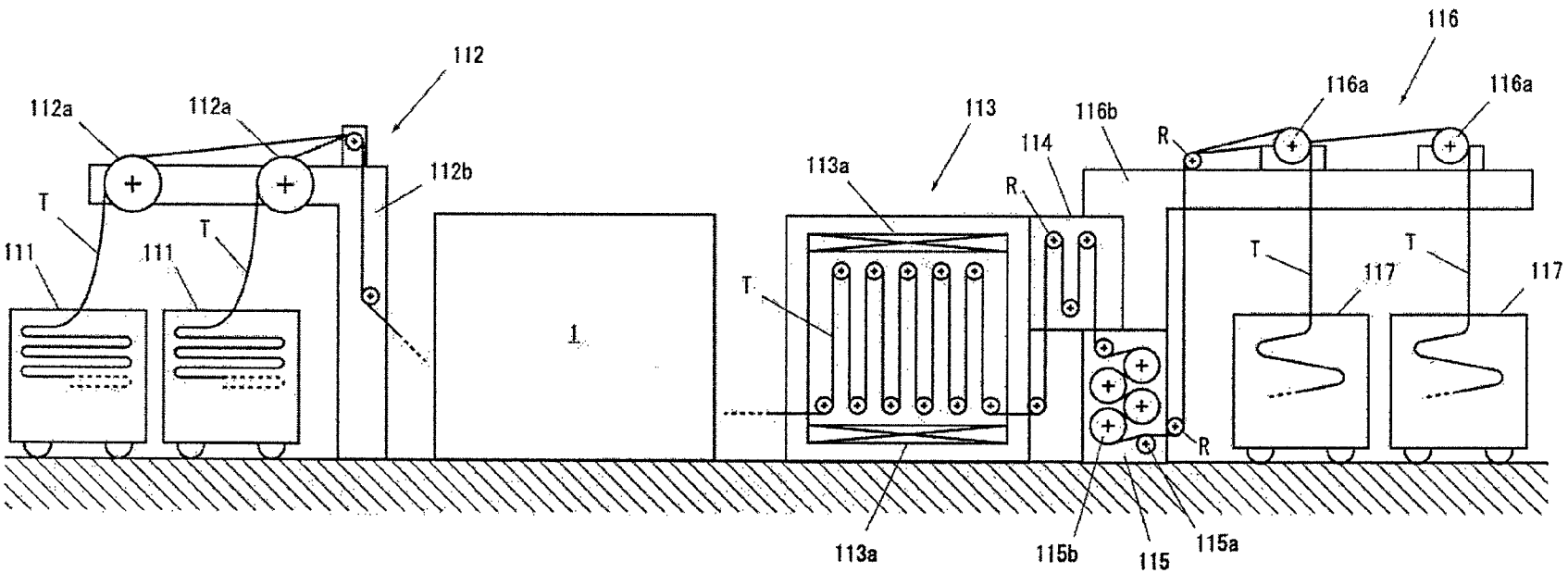
FIG. 8 is a configuration diagram showing an inkjet dyeing apparatus according to a fourth embodiment of the present invention.

An inkjet dyeing apparatus according to a fourth embodiment of the present invention is described below. FIG. 8 is a configuration diagram showing an inkjet dyeing apparatus according to a fourth embodiment of the present invention. The fourth embodiment as shown in FIG. 8 has a second drying step for drying both surfaces of the textile T, which follows the rear surface drying step. In other words, the inkjet dyeing apparatus 11 according to the fourth embodiment is the inkjet dyeing apparatus 1 according to the first to third embodiments, which has a second drying section 113 provided downstream thereof for securely drying both surfaces of the textile T subjected to both-surface printing, thereby developing ink as well as fixing ink to the textile T. The second drying section 113 includes, for example, an electrically-heated oven having an electrical heater 113*a* therein, which has a plurality of transporting rollers R provided therein for causing the textile T to meander.

The structure of the entire inkjet dyeing equipment having the inkjet dyeing apparatus 11 as described above is described below. The inkjet dyeing equipment as shown in FIG. 8 includes a feeding dolly 111 for transporting a pre-dyed, plain textile T, a first relaying section 112 for relaying downstream the textile T on the feeding dolly 111, an inkjet dyeing apparatus for printing the textile T, a cooling section 114 for cooling the textile T subjected to the second drying step, a transporting section 115 for transporting out the textile T subjected to the second drying step, a second relaying section 116 for relaying downstream the textile T subjected to the second drying step, and a transporting dolly 117 for transporting the textile T subjected to dyeing. Although not illustrated, the textile T subjected to dyeing by the inkjet dyeing equipment may be washed to add texture after recovered with the transporting dolly 117, or the printed surfaces may be coated with a resin for protecting the printed surface. Alternatively, the inkjet dyeing equipment may be structured so as to allow the washing step and the resin coating step to be successively performed following the second drying step.

The relaying section 112 includes a drum 112*a* for receiving the textile T from the feeding dolly 111, a transporting roller R for transporting the textile T, and a support pillar 112*b* for supporting the drum 112*a* and the transporting roller R. The cooling section 114 is a section for allowing the textile T subjected to the second drying step to dry naturally, transporting the textile T by a certain distance through a plurality of transporting rollers R. Like the transporting section 8 of the inkjet dyeing apparatus 1 according to the first to third embodiments, the transporting section 115 has a dancer roll 115*a* and a tension roll 115*b*. A predetermined elongation is given to the textile T between the transporting sections 8, 115. The second relaying section 116 includes a drum 116*a* for passing the textile T to the transporting dolly 117, a transporting roller R for transporting the textile T, and a support pillar for supporting the drum 116*a* and the transporting roller R. The drum 116*a* may be movably disposed on the support pillar 116*b*.

The present invention is typically described with reference to, but not limited to, the foregoing preferred embodiments. Various modifications are conceivable within the scope of the present invention, including a pretreatment to allow ink to adapt to the textile T or prevent ink from excessively soaking into the textile T before the textile T is fed into the inkjet dyeing apparatus 1, 11.

The disclosure of Japanese Patent Application No. 2008-222775 filed on Aug. 29, 2008 is incorporated as a reference.

While the invention has been explained with reference to the specific embodiments of the invention, the explanation is illustrative and the invention is limited only by the appended claims.

What is claimed is:

1. An inkjet dyeing method for dyeing a belt-shape textile by ejecting ink, comprising:

a feeding step of feeding the textile to an inkjet dyeing apparatus;

a front surface printing step of dyeing the textile by ejecting the ink onto a front surface of the textile;

a front surface drying step of drying the front surface of the textile;

an inverting step of inverting the textile;

a rear surface printing step of dyeing the textile by ejecting ink onto a rear surface of the textile; and a rear surface drying step of drying the rear surface of the textile, wherein the inverting step comprises a first inverting step of inverting the textile transferred from the front surface drying step substantially 90 degrees, a turning step of turning the textile inverted by the first inverting step, and a second inverting step of inverting the textile inverted substantially 90 degrees by the first inverting step and transferred from the turning step further substantially 90 degrees and transporting the textile to the rear surface printing step.

2. The inkjet dyeing method according to claim 1, wherein the textile is conveyed along a loop shape passage so that the front surface printing step and the rear surface printing step are simultaneously performed.

3. The inkjet dyeing method according to claim 1, wherein in the inverting step, the textile is inverted in such a manner that the textile before the inverting step runs parallel with the textile after the inverting step.

4. The inkjet dyeing method according to claim 1, wherein, in the front and rear surface drying steps, the textile is dried so that the ink does not migrate to a transporting roller.

5. The inkjet dyeing method according to claim 1, further comprising a second drying step of drying both sides of the textile after the rear surface drying step.

6. The inkjet dyeing method according to claim 1, wherein the front surface printing step includes a first front surface printing step and a second front surface printing step conducted after the first front surface printing step, and the rear surface printing step includes a first rear surface printing step and a second rear surface printing step conducted after the first rear surface printing step.

* * * * *